US008246371B2

(12) United States Patent
Emerson

(10) Patent No.: US 8,246,371 B2
(45) Date of Patent: Aug. 21, 2012

(54) HIGH PRESSURE, HIGH TEMPERATURE STANDOFF FOR ELECTRICAL CONNECTOR IN AN UNDERGROUND WELL

(76) Inventor: Tod D. Emerson, Cypress, TX (US)

( * ) Notice: Subject to any disclaimer, the term of this patent is extended or adjusted under 35 U.S.C. 154(b) by 0 days.

(21) Appl. No.: 13/059,922

(22) PCT Filed: Aug. 19, 2009

(86) PCT No.: PCT/US2009/054266

§ 371 (c)(1),
(2), (4) Date: Feb. 18, 2011

(87) PCT Pub. No.: WO2010/022123

PCT Pub. Date: Feb. 25, 2010

(65) Prior Publication Data

US 2011/0165786 A1 Jul. 7, 2011

Related U.S. Application Data

(60) Provisional application No. 61/090,209, filed on Aug. 19, 2008.

(51) Int. Cl.
*H01R 13/52* (2006.01)

(52) U.S. Cl. ..... 439/279

(58) Field of Classification Search ..... 439/278, 439/279, 587–589; 166/54.1, 65.1
See application file for complete search history.

(56) References Cited

U.S. PATENT DOCUMENTS

| | | | |
|---|---|---|---|
| 4,614,392 | A | 9/1986 | Moore |
| 5,642,780 | A | 7/1997 | Moore |
| 5,894,104 | A | 4/1999 | Hedberg |
| 2003/0131993 | A1 | 7/2003 | Zhang |
| 2008/0175300 | A1 | 7/2008 | Billington |

*Primary Examiner* — Ross Gushi
(74) *Attorney, Agent, or Firm* — David B. Dickinson

(57) ABSTRACT

A standoff for providing a fluid-tight seal for an electrical connection in a well between an electrical conductor extending from down hole of the well and a power source conductor extending from an above-ground power source is enclosed by and extends through and further into the wellbore. The power source conductor extends down hole to a connector for connecting the power source conductor to the electrical conductor. The standoff includes a rigid tube adapted to extend through a wellhead barrier of the well and terminate at a lower end. A rubber boot surrounds the rigid tube. An electrical insulative tubular body has a hole forming a first inner surface surrounding the power source cable between the lower end of the rigid tube and the connector, the rubber boot surrounding the tubular body. A sleeve is placed at one end of the tubular body and has a second, larger hole coaxial with the first hole and forming a second inner surface. An internal surface is formed between the first and second inner surfaces, the lip surrounding a portion of the rigid tube adjacent the lower end and the internal shoulder engages the lower end of the rigid tube for preventing the rubber boot from extruding between the tubular body and the rigid tube when pressurized and evenly distributing the compressive force on the end of the standoff. On the other end of the standoff, a washer sits atop the electrical connector and supports the insulation.

8 Claims, 3 Drawing Sheets

PRIOR ART

HIGH PRESSURE, HIGH TEMPERATURE STANDOFF FOR ELECTRICAL CONNECTOR IN AN UNDERGROUND WELL

CROSS REFERENCE TO RELATED APPLICATIONS

This is a non-provisional application claiming priority to U.S. Provisional Application No. 61/090,209, filed by applicant herein on 19 Aug. 2008.

TECHNICAL FIELD OF INVENTION

The present invention relates to an electrical connection device; specifically, to a high-pressure, high-temperature resistant standoff to insulate an electrical conductor preventing failure in a wellbore.

BACKGROUND OF THE INVENTION

Electrical connectors for oil wells using electrical submersible pumps (ESPs) are subjected to a variety of harsh and demanding operating environments. As worldwide demand for oil has increased, demand for ESP service in deeper and more challenging environments have presented the pump manufacturer and the companies providing service and peripheral equipment to the pump companies with a number of difficult problems. The continual pressurization and depressurization of well connectors has heretofore led to early and catastrophic failures of ESP systems. The advent of the electrical connectors shown in the prior art and referenced below has dramatically improved the failure rate among ESP installations and led to widespread commercial success of this form of electrical connector. However, recent failures caused by arc over of the electrical conductor in the electrical connectors described in the prior art, particularly in deep, hot and high-pressure wells have exposed additional problems not heretofore understood or appreciated and provided the impetus for further study and this solution to the problems previously incapable of solution. The improvements in this application are expected to make such wells as successful with ESP completions as experienced in non-troublesome wells.

STATEMENT OF THE PRIOR ART

This application is an improvement over the standoff disclosed in U.S. Pat. No. 5,642,780 issued Jul. 1, 1997 to Boyd B. Moore, which is incorporated herein by reference to show the state of the prior art and the problems overcome by the present invention.

SUMMARY OF THE PRESENT INVENTION

A high-temperature, high-pressure standoff for providing a fluid-tight seal for an electrical connection in a well between an electrical conductor extending from down hole of the well and a power source conductor extending from an above-ground power source enclosed by and extending through and further into the wellbore in a rigid tube surrounding an electrical conductor and an insulating sheath over the electrical conductor terminating in a rubber boot surrounding the rigid tube, the power source conductor extending down hole to a connector socket for connecting the power source conductor to the electrical conductor. The high-temperature, high-pressure standoff within said connector is fabricated with an electrically resistive metal sleeve having a first inner surface having an inner diameter permitting the rigid tube to be inserted therein and a second inner surface having an inner diameter permitting the electrical conductor and an insulating sheath to be inserted therein and an inner shoulder between said first and second inner surfaces having a width approximating the width of the rigid tube to seat an end of the rigid tube; an electrically insulative tubular body having a hole forming an inner surface surrounding the power source conductor between the lower end of the rigid tube and the connector, the rubber boot coaxially surrounding the tubular body and conductor; and, an electrically resistive washer intermediate the end of the tubular body and insulating sheath and a conductor socket for connecting the conductor.

This high-temperature, high-pressure standoff is preferably formed from a high voltage, high strength, ceramic insulator material, but can formed from a high voltage, high strength, glass-filled insulator phenolic material.

The high-temperature, high-pressure standoff ceramic insulator compound can be composed essentially of 99.5% $Al_2O_3$ by weight. Alternatively, but less preferably, the high-temperature, high-pressure standoff ceramic insulator compound can be composed essentially of composed essentially $SiO_2$, 46%, MgO 17%, $Al_2O_3$ 16%, $K_2O$ 10%, $B_2O_3$ 7%, and F 4% (by weight).

The high-temperature, high-pressure standoff additionally can additional provide a washer placed between the high-temperature, high-pressure standoff and the connector socket to evenly distribute the compressive forces between the socket and the standoff. Both the washer and the electrically resistive metal sleeve may be fabricated from materials such as stainless steel or a material having a conductivity of not more than 1.45 E +06 Siemens/M.

This new improved standoff arrangement permits an electrical connector for electrically connections to a conductor extending from down hole in a well to a power source conductor, said electrical connector comprising a rigid tube enclosing said source conductor; the connector socket electrically terminating the end of the power source conductor past the end of the rigid tube; permitting a sleeve having a longitudinal hole therethrough having a bore accommodating the rigid tube on one end and providing an interior shoulder against which said rigid tube engages while permitting the source conductor to extend therethrough surrounding the power source conductor between the end of the rigid tube and said connector socket; an insulating tubular standoff having a hole forming an inner surface permitting the passage of the electrical conductor; and a rubber boot surrounding said connector socket and said standoff. The washer placed between the insulating tubular standoff and the connector socket fully and evenly distributes the compressive forces imposed on the tubular standoff by the connector socket, making these successful electrical connector arrangements to be used in harsh, deed, high-temperature and high-pressure well environments.

DETAILED DESCRIPTION OF THE PREFERRED EMBODIMENT

Figure 1:
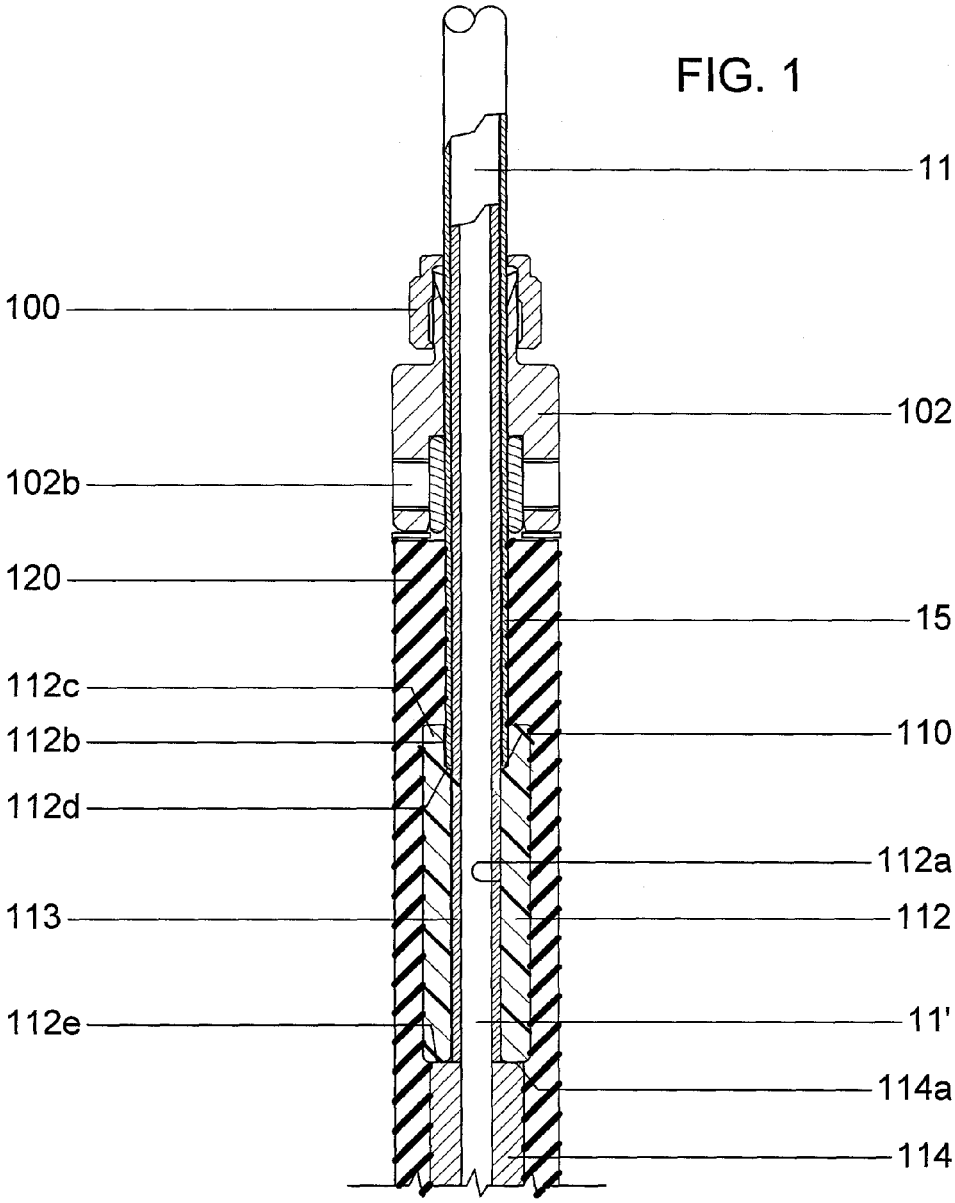
FIG. 1 is a partial sectional view illustrating a standoff according to the prior art.

U.S. Pat. No. 5,642,780 issued on Jul. 1, 1997, to Moore, is incorporated herein by reference to show the state of the art prior to the present application. Detailed reference to this patent and the drawings shown therein will make understanding the scope and purpose of the present invention readily comprehensible. As shown in FIG. 1, an insulated conductor cable is inserted in a wellbore and connected to a splice preferably made of a non-ferromagnetic, electrically conductive material, such as stainless steel, for example, or the like. The top fitting 100 is preferably a ferrule-type fitting, such as, for example, Swagelok®, or the like, so that the top fitting 100 is fixedly attached to the rigid tube 15.

The top fitting 100 is preferably a close fit having a relatively tight tolerance around the rigid tube 15. The top fitting 100 is preferably tightened to crimp the rigid tube 15 to form a fluid seal. This choking effect of the rigid tube 15 by the top fitting 100 further prevents fluid flow from the wellbore to atmospheric pressure outside the wellhead (not shown).

The top stop 102 includes a corresponding threaded hole 102*b* for receiving the screw which aligns with an outer sleeve slid around the top stop 102 so that the outer holes and holes 102*b* are aligned, and a screw (not shown) is screwed into the threaded hole 102*b* through the hole of the outer sleeve and tightened to the rigid tube 15 to affix the outer sleeve to the top stop 102, which is attached to or integrally formed with the top fitting 100.

The rigid tube 15 extends past the connector to a lower end 110, which engages a standoff 112. The electrical conductor means 11 extends beyond the lower end 110 of the rigid tube 15 through the standoff 112 to the upper end 114*a* of a female connector socket 114. The insulation 113 of the electrical conductor means 11 is stripped off exposing the conductor element portion 11', which is crimped and/or soldered to electrically and mechanically connect it to the female connector socket 114, as is well known to those skilled in this art.

The female connector socket 114 includes a socket portion at its opposing end for receiving a male connector pin (not shown). It is noted that the particular male and female connectors described herein could be reversed, or otherwise replaced with other slideable connector means as known, so that the prior invention was not limited by any particular connector means. The male connector pin and the female connector socket 114 are formed of any suitable electric conducting material such as copper, or the like, and each is formed by a plurality of longitudinally extending portions which are configured to axially align and mate. A similar connection configuration is more fully described in the U.S. Pat. No. 4,614,392, which is hereby incorporated by reference as if copied verbatim herein. In this manner, the male connector pin and the female connector socket 114 are coupled together for electrically connecting the down hole cable conductors to the electrical conductor means 11.

As previously noted in the cited prior art, three similar down hole cable conductors are found in the normal installation, although only one is shown herein. The conductor cable extends upwards from the ESP to penetrate a connector, where the cable is electrically and mechanically connected to the male connector pin in a similar manner as described for the electrical conductor means 11 and the female connector socket 114.

A female boot 120, preferably molded from rubber, is formed to surround the rigid tube 15, the standoff 112 and the female connector socket 114 for electrically isolating the conducting portions from the outer sleeve. The female boot 120 includes a longitudinal passage for receiving a projecting end portion of a male boot. The male boot is inserted into the female boot 120 and locked. The male boot also molded from rubber, is formed to surround the electrical conductor and the male connector pin for electrical isolation from the enclosing outer sleeve. The male and female boots 120 have outer surfaces which are preferably snugly fill the outer sleeve. The outer sleeve is thus electrically isolated from the conductive portions of the electrical conductor connectors.

In operation of most wells, the entrained gas and oil exerts a significant amount of pressure which may be applied against the barrier or wellhead. The fluid within the wellbore forms a fluid column which rises and falls depending upon the formation pressure and whether the down hole pump is turned on or off. When the pump is turned off, the fluid column typically rises causing a high-pressure area surrounding the connectors. This high-pressure in these types of wells can still reach the pressure rating of the wellhead, which could be 5,000 to 10,000 psi or more. In contrast, the surrounding air outside the wellhead is at relatively low pressure. In current ESP production schemes, well connectors are being used far deeper in the wellbore and are often found under cowls having multiple pump installations deep within the well and approaching total bottom depth where geophysical temperatures and pressures are significantly higher than those experienced near the wellhead.

Due to this high-pressure, the male and female boots 120 typically become saturated with well fluids. When the ESP is turned on, it pumps fluid up the production tubing typically causing the fluid column to fall, so that the annular area surrounding the connector below the wellhead becomes relatively depressurized. The fluid impregnated male and female boots 120 can not release the fluid fast enough, so that a pressure differential exists between the inside of the electrical connector and the surrounding depressurized area. The rubber of the male and female boots 120 tends to expand to force the male and female boots 120 apart, which would otherwise separate a male connector pin from the female connector socket 114. Due to the top stop 102, the bottom stop (not shown) and the outer sleeve, the rubber boots 120 are confined and cannot readily expand so that the connector remains intact. Further, since the top fitting 100 is fixedly attached to the rigid tube and attached to or integrally formed with the top stop 102, the rigid tube 15 is not forced out of the connector, so that the connector remains intact throughout the expansion and contraction phases of the well cycle.

Figure 2:
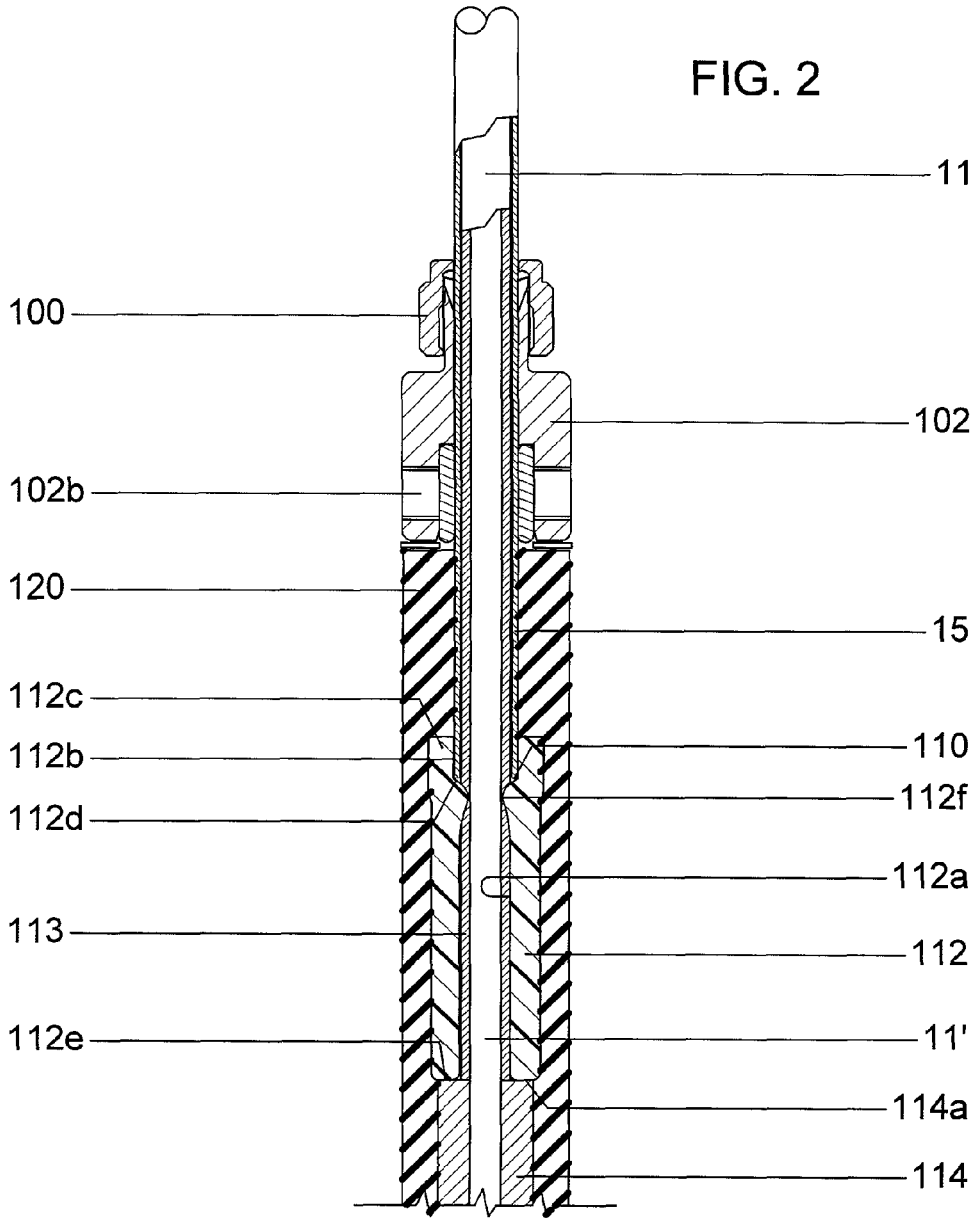
FIG. 2 PRIOR ART
FIG. 2 is a partial cross-sectional view of the female end of the standoff assembly described in the prior art showing details of the counterbored shoulder failure mechanism experienced by the prior art devices in hot, high-pressure wellbores which prompted the present improvement over the prior art standoff.

Referring now to FIG. 2, a partial sectional view of the electrical connector is shown illustrating the failing standoff 112. As shown, the standoff 112 preferably has a larger diameter than the female connector socket 114 for proper placement of the rubber female boot 120. When the down hole pump is turned off, any fluid existing in the high-pressure area seeps inside the connector 23 and impregnates the male (not shown) and female boots 120. A low pressure area exists inside the rigid tube 15 relative to the high pressure annular area outside the connector and the boots 120. The pressurized fluid impregnated rubber of the boots 120 tends to expand within the connector, thereby forming a tighter seal on all passages through which well fluids might flow. It is undesirable for fluid to escape through the rigid tube 15 via the electrical conductive means 11 comprising the conductor element portion 11' and the insulation 113.

The standoff 112 of the prior art was formed of a reinforced, high voltage, high strength insulator material. The material was a glass-filled laminate phenolic material, such as Westinghouse G-10, for example. The standoff 112 had a hole 112*a* with a diameter for surrounding the insulation 113 of the electrical conductive means 11, and a second, larger diameter hole 112*b* on one end extending part way into the standoff 112. The second hole 112*b* was carefully counterbored to receive the rigid tube 15 to create a tight fit. The second hole 112*b* also formed an extension lip 112*c* for circumscribing the rigid tube 15, and a shoulder 112*d* engaging the lower end 110 of the rigid tube 15. In spite of the high-pressure, it was previously noted that the rubber of the female boot 120 could extend slightly between the extension lip 112*c* and the rigid tube 15, but was previously thought to not penetrate all the way to the shoulder 112*d*. In fact, the lower end 110 of the rigid tube 15 was previously believed to be forced into the shoulder 112*d* of the standoff 112 forming an effective fluid seal due to the pressure applied by the surrounding rubber, and the low pressure within the rigid tube 15. The standoff 112 had what was believed to be a relatively wide flat face at a lower end 112*e* engaging the upper end 114*a*, which is also relatively wide and flat, to thereby form a fluid seal. The hydraulic pressure differential was intended to force the female connector socket 114 against the lower end 112*e* of the standoff 112. Thus, fluid was thought to be restrained or not permitted to escape past the standoff 112, allowing for a greater seal.

These prior art standoffs work in most applications and can withstand pressures as high as 10,000 psi without failure. However, arc over failures have been experienced in deep, hot, high-pressure wells. Lab test of these connector with elevated temperature and pressures failed to reveal the failure mechanism until they were left in well-like conditions for extended periods of time. Failures appear to have been caused by the standoff being deformed over extended periods of time to well-like heat and pressure gradients. In these failures, the entire assembly is compressed by the hydrostatic build-up as the counterbore shoulder 112*d* is driven down against the stainless steel tubing 15 causing the laminate material of the standoff to deform, expand or crack 112*f*, and eventually fail.

Figure 3:
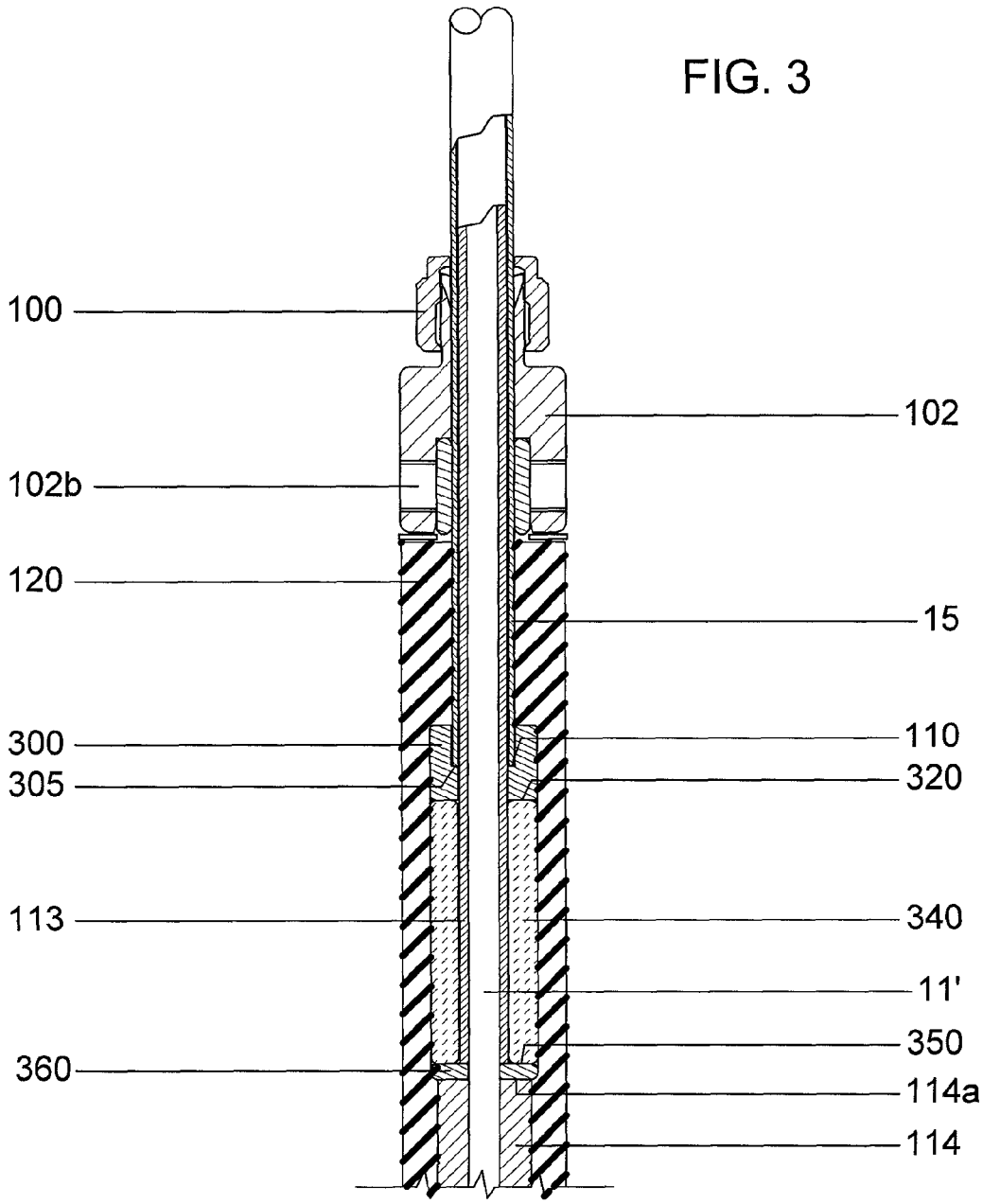
FIG. 3 is a partial cross-sectional view of the female end of the standoff assembly showing the solution to the deformation or creep experienced by the standoff after prolonged exposure to high-temperature and high-pressure.

To overcome this problem, as shown in FIG. 3, a stainless steel sleeve 300 has been fabricated to fit between the steel tube 15 and the standoff 340. This stainless steel sleeve 300 is counterbored to provide a flat shoulder 305 to seat the rigid tubing 15 and prevents the tubing from unduly compressing against the shoulder 305. The fittened bottom 320 of the sleeve 300 fully seats on top of the standoff 340 and prevents the tubing 15 from being driven into the standoff 340, correcting the problem as shown in FIG. 2, which is believed to be the principal cause of the prior failures. On the other end of the standoff 340, a stainless steel washer 360 is placed around the conductor 11' and between the upper surface 114*a* of electrical connector socket 114 and the standoff body 340 to prevent compressive forces from driving the socket between the edge of the standoff 340 and the insulator sheath 113, each of which are supported by the upper surface 350 of washer 360. These details are shown in greater detail in FIG. 3. The boot 120, the cap 102 and hole 102*b* for anchoring the cap 102 and compressing a bushing around the tubing 15, all function in the manner previously shown in the prior art.

FIG. 3 is a detailed partial cross sectional view of the top portion of the female end of the electrical connector where the insulative standoff 340 had previously been made of the material described in U.S. Pat. No. 5,642,780, a glass fiber laminated phenolic insulation which worked in most applications. However, in long hot and high-pressure environments, it was discovered the material degraded or deformed causing catastrophic failures. Applicant found in extended, high-temperature high-pressure applications that standoff made from ceramics, such as 99.5% alumina ($Al_2O_3$), provided by CoorsTek, Inc. of Golden, Colo., and which is sold under the tradename, AD-995 is optimal for this application. Other alternative materials are Corning Glass Works Macor™ which is a compound of $SiO_2$, 46%, MgO 17%, $Al_2O_3$16%, $K_2O$ 10%, $B_2O_3$ 7%, and F 4% (by weight), which can be machined, has a rated continuous use temperature of 800° C. and a peak temperature of 1000° C., a dielectric strength of at 785 V/mil yet providing a compressive strength of 50,000 psi provided adequate service in these environments. The alumina ceramic material for the standoff 340 provides a compressive strength at 20° C. of 2600 Mpa (377 psi×$10^3$), a Rockwell 45N hardness of 83, a maximum use temperature of 1750° C., 0 gas permeability, and 8.7 ac-kV/mm (220 acV/mil) dielectric strength.

The steel tube 15 is inserted in the sleeve 300 which provides a flat shoulder 305 to fully support the compressive force of the tube against which the end of the steel tube 110 fully sets. The counterbore of the prior art device encouraged the tube to lift and separate the laminate material 112 (as shown in FIG. 2 at 112*f*). In the present embodiment, the stainless steel sleeve 300 fully distributes the load to the end of the standoff 340 evenly. The insulation around the conductor 113 is stripped off at the end of the standoff 340 and a stainless steel washer 360 is placed to support the standoff against the end of the socket 114, into which is placed the bare conductor 11'. The compressive loading experienced by the standoff 340, whether made from the preferred alumina material or from the less preferred Westinghouse G-10 material or the Corning Macor material is evenly distributed over the entire end of the standoff tube and are believed to therefore be well within the mechanical compressive strength of both materials. Additionally, by avoiding the counterboring found in preparing the prior art standoff device (112 of FIGS. 1 and 2) that caused the failure, the cost of preparation of the entire assembly will be reduced since no careful counterboring need be done to the standoff 340 after the hole is drilled for the conductor and insulation sheath. This new arrangement minimizes machine shop spoilage of these small parts. Moreover, assembly of the standoff of the prior art embodiment required careful attention to the possibility of cracking the phenolic-resin standoff from forcing the rigid steel tube 15 into the seat in the counterbore 112 in FIG. 1. Installation cracking from inserting the steel tube 15 in the standoff 340 at an angle eliminated this problem, making installation easier and faster, minimizing costly downtime for the well. Additionally, with the prior art embodiment, care was required to avoid stressing the electrical connector to avoid cracking the standoff, after assembly. Often, when banding the electrical conductor cable to the production tubing, stress would be placed on the connection cracking the standoff on the interior of the connector splice while it remained out of the view of the installer. This cracking could lead to failure of the connection by arc-over. This care is no longer critical, making the connection more durable in normal field environments.

This new design provides a stronger, and therefore superior, insulation material to prevent the arc over failures experienced by the existing prior art designs. It is now appreciated that each of the three electrical connectors (of which only one is shown) for connecting the electrical conductor means provides an effective seal preventing fluid from escaping through the rigid tubes 15, and remains intact during pressurization and depressurization occurrences in the well even in high-temperature conditions. This new overall design of these electrical connectors provides ESP service in both regular oil wells and in deep, hot and high-pressures well currently being put into production worldwide fostering enhanced market acceptance of ESP solutions.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. A high-temperature, high-pressure standoff for providing a fluid-tight seal for an electrical connection in a well between an electrical conductor extending from down hole of the well and a power source conductor extending from an above-ground power source enclosed by and extending through and further into the wellbore in a rigid tube surrounding an electrical conductor and an insulating sheath over said electrical conductor terminating in a rubber boot surrounding the rigid tube, the power source conductor extending down hole to a connector socket for connecting the power source conductor to another electrical conductor, tie high-temperature, high-pressure standoff within said connector comprising:

an electrically resistive metal sleeve having a first inner surface having an inner diameter permitting the rigid tube to be inserted therein and a second inner surface having an inner diameter permitting the electrical conductor and an insulating sheath to be inserted therein and an inner shoulder between said first and second inner surfaces having a width approximating the width of the rigid tub to seat an end of the rigid tube;

an electrically insulative tubular body having a hole forming an inner surface surrounding the power source conductor between the lower end of the rigid tube and the connector, the rubber boot coaxially surrounding the tubular body and conductor; and, an electrically resistive washer intermediate the end of the tubular body and insulating sheath and a conductor socket for connecting the conductor.

2. The high-temperature, high-pressure standoff of claim 1, wherein said electrically insulative tubular hod is formed of a high voltage, high strength, ceramic insulator material.

3. The high-temperature, high-pressure standoff of claim 1, wherein said electrically insulative tubular body k formed of a high voltage, high strength, ceramic insulator compound composed essentially of 99.5% $Al_2O_3$ by weight.

4. The high-temperature, high-pressure standoff of claim 1, wherein said electrically insulative tubular body is formed of a high voltage, high strength, ceramic insulator compound composed essentially of $SiO_2$, 46%, MgO 17%, $Al_2O_3$ 16%, $K_2O$ 10%, $B_2O_3$ 7%, and F 4% (by weight).

5. The high-temperature, high pressure standoff of claim 1 wherein the electrically resistive metal sleeve is stainless steel.

6. The high-temperature, high-pressure standoff of claim 1 wherein the electrically resistive washer is stainless steel.

7. The high-temperature, high-pressure standoff of claim 1 wherein the electrically resistive metal sleeve is fabricated from a material having a conductivity of not more than 1.45 E +06 Siemens/M.

8. The high-temperature, high-pressure standoff of claim 1 wherein the electrically resistive washer is fabricated from a material having a conductivity of not more than 1.45 E +06 Siemens/M.

* * * * *

UNITED STATES PATENT AND TRADEMARK OFFICE

CERTIFICATE OF CORRECTION

PATENT NO. : 8,246,371 B2
APPLICATION NO. : 13/059922
DATED : August 21, 2012
INVENTOR(S) : Tod D. Emerson It is certified that error appears in the above-identified patent and that said Letters Patent is hereby corrected as shown below:

Col. 2 Line 34: “electrically connections” should be “electrical connections”
Col. 7 Line 24: “tie” should be “the”
Col. 7 Line 34: “rigid tub” should be “rigid tube”
Col. 8 Line 10: “hod” should be “body”
Col. 8 Line 13: “k” should be “is”

Signed and Sealed this
Thirteenth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,246,371 B2
APPLICATION NO. : 13/059922
DATED : August 21, 2012
INVENTOR(S) : Emerson It is certified that error appears in the above-identified patent and that said Letters Patent is hereby corrected as shown below:

Col. 2 Line 26: Summary of the Present Invention: “can additional provide” should be “can provide”

Col. 2 Line 34: Summary of the Present Invention: “connector for electrically connections” should be “connector for electrical connections”

Col. 2 Line 53: “deed” should be “deep”

Col. 4 Line 12: “surfaces which are preferably snugly fill” should be “surfaces which are preferably snugly filling”

Col. 7 Line 34, Claim 1: “rigid tub” should be “rigid tube”

Signed and Sealed this
Twenty-seventh Day of November, 2012

David J. Kappos

David J. Kappos
*Director of the United States Patent and Trademark Office*